US008229149B2

(12) United States Patent
Kasanmascheff

(10) Patent No.: US 8,229,149 B2
(45) Date of Patent: Jul. 24, 2012

(54) HEARING APPARATUS WITH VISUALLY ACTIVE HOUSING

(75) Inventor: Robert Kasanmascheff, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 686 days.

(21) Appl. No.: 12/313,181

(22) Filed: Nov. 18, 2008

(65) Prior Publication Data

US 2009/0129615 A1 May 21, 2009

(30) Foreign Application Priority Data

Nov. 20, 2007 (DE) ..... 10 2007 055 382

(51) Int. Cl.
*H04R 25/00* (2006.01)

(52) U.S. Cl. ..... 381/322

(58) Field of Classification Search ..... 381/322; 429/189, 249

See application file for complete search history.

(56) References Cited

U.S. PATENT DOCUMENTS

2002/0081982 A1 6/2002 Schwartz et al.
2004/0044383 A1 3/2004 Woods et al.
2005/0253159 A1* 11/2005 Creswick et al. ..... 257/98
2005/0254677 A1* 11/2005 Reithinger ..... 381/322
2008/0008343 A1* 1/2008 Husung ..... 381/322
2009/0024152 A1* 1/2009 Boyden et al. ..... 606/155

FOREIGN PATENT DOCUMENTS

DE 19735803 A1 2/1999
DE 102 05 579 A1 8/2003
DE 10 2004 023 047 B3 11/2005
WO 2008107744 A1 9/2008

OTHER PUBLICATIONS

Lindsay Ficke and Marc Cahay, "The bright future of organic LEDs", IEEE Potentials, Dec. 2003/ Jan. 2004, pp. 31-34.

* cited by examiner

*Primary Examiner* — Jasmine Clark

(57) ABSTRACT

A hearing apparatus to be worn on or in the ear is provided, which includes a housing. The housing is here formed at least in part from an electrochrome polymer. Since electrochrome polymers represent a homogeneous material, this means that they can be printed onto the housing in very thin layers. According to a second aspect the present invention relates to a hearing apparatus to be worn on or in the ear, including a housing, which has an organic light-emitting diode. Because organic light-emitting diodes are able to separate out light in a wide variety of colors, this permits a high contrast to the environment and the colors appear stronger. Unlike conventional light-emitting diodes this is however performed in a printing process, so that it is possible to provide any surfaces with organic light-emitting diodes.

18 Claims, 3 Drawing Sheets

HEARING APPARATUS WITH VISUALLY ACTIVE HOUSING

CROSS REFERENCE TO RELATED APPLICATIONS

This application claims priority of German application No. 10 2007 055 382.1 DE filed Nov. 20, 2007, which is incorporated by reference herein in its entirety.

FIELD OF INVENTION

The present invention relates to a hearing apparatus for wearing on or in the ear, including a housing. The term hearing apparatus here means a hearing aid in particular. However, also covered by the term are other wearable acoustic devices such as headsets, earphones and the like.

BACKGROUND OF INVENTION

Hearing aids are wearable hearing apparatuses design to assist the hard of hearing. To meet the numerous individual needs, various designs of hearing aid such as behind-the-ear hearing aids (BTE), hearing aids with an external receiver (RIC: receiver in the canal) and in-the-ear hearing aids (ITE), e.g. including concha hearing aids or canal hearing aids (ITE, CIC), are provided. The hearing aids listed by way of example are worn on the outer ear or in the auditory canal. However, bone conduction hearing aids, implantable or vibrotactile hearing aids are also available on the market, in which the damaged hearing is stimulated either mechanically or electrically.

In principal the main components of a hearing aid are an input converter, an amplifier and an output converter. The input converter is generally a sound receiver, e.g. a microphone, and/or an electromagnetic receiver, e.g. an induction coil. The output converter is mostly implemented as an electroacoustic converter, e.g. miniature loudspeaker, or as an electromagnetic converter, e.g. bone conduction receiver. The amplifier is normally integrated into a signal processing unit. This basic structure is illustrated in FIG. 1 using the example of a behind-the-ear hearing aid. A hearing aid housing 1 for wearing behind the ear incorporates one or more microphones 2 to receive the sound from the environment. A signal processing unit 3, likewise integrated into the hearing aid housing 1, processes the microphone signals and amplifies them. The output signal from the signal processing unit 3 is transferred to a loudspeaker or receiver 4 which emits an acoustic signal. The sound is if necessary transferred to the ear drum of the hearing aid wearer via a sound tube which is fixed in the auditory canal with an otoplastic. The hearing aid and in particular the signal processing unit 3 is supplied with power by a battery 5 likewise integrated into the hearing aid housing 1.

SUMMARY OF INVENTION

The current interest is in a visual reproduction of information which can be evaluated in respect of an operating state of the hearing aid. Thus hearing aids are known from the prior art in which electrophoretic displays are used for this purpose. The publication DE 10 2004 023 047 B3 discloses a hearing aid in which status information, for example a setting status of the hearing aid, the battery charge status, a selected program or a volume setting can be reproduced on an electrophoretic display. The term electrophoresis here means the migration of charged particles in an electric field. The visual impression is created in that for example the differently charged and differently colored parts of particles are turned toward the viewer. Alternatively, two colors can be present in a dispersion and can be separated by the electric field, as a result of which one color is covered by the other. An aspect of these known hearing aids regarded as a drawback is the fact that the quality of the representation achieved by the electrophoretic display still leaves a lot to be desired. Another drawback is that the minimum pixel size for electrophoretic displays is relatively large. In addition the hearing aids with the dispersion-bearing capsules are visually not very attractive because of their thickness and thus the layer additionally formed on the housing.

Furthermore, with conventional hearing aids status information is reproduced with the aid of an LCD display (liquid crystal display).

It is the object of the present invention to provide a hearing apparatus to be worn on or in the ear, in which measures are taken with the minimum of expense to enable an improved reproduction of information in respect of the quality.

According to a first aspect of the invention this object is achieved by a hearing apparatus to be worn on or in the ear, including a housing, which is formed at least in part from an electrochrome polymer.

Since electrochrome polymers represent a homogeneous material, no additional step is needed besides applying this material and the contacting. As a result a lower-cost hearing apparatus can be created as regards manufacture. Thanks to the inventive hearing apparatus it is advantageously possible for the housing to change its color at least in part, depending on electrical excitation. As a result a user or a support person is able to read the current operating state of the hearing apparatus from the color of the housing. Furthermore, very fine structures can be created from the electrochrome polymers and can be applied to curved surfaces at particularly low cost. Thanks to the extremely low power draw, the load on the battery is also low. As a result an energy-efficient hearing apparatus is created. Finally the electrochrome polymers have the advantage of high robustness.

In a further embodiment an outer layer of the housing is formed from the electrochrome polymer. Especially in the case of hearing aids in which the shape of the housing is matched to the anatomy of the user, the use of electrochrome polymers means that very thin layers can easily be applied to curved surfaces.

Alternatively the whole housing can be formed from one or more electrochrome polymers. As a result a hearing apparatus which is efficient in terms of manufacture is created.

Preferably one area of the housing made of electrochrome polymer represents a symbol which is assigned to an operating state of the hearing apparatus. In particular a symbol can be assigned to each operating state or each program of the hearing apparatus, it being possible to highlight the color of the respective symbol as a function of the program of the hearing apparatus currently selected. As a result the user or the support person is, able to read the device status from the color of the respective symbol. In addition the symbols can also be used to customize the hearing apparatus.

In one embodiment the hearing apparatus can be formed as an in-the-ear hearing aid, it being possible for the housing to be formed on a side facing away from a sound exit opening at least in part from the electrochrome polymer. This means that the part of the housing formed from the electrochrome polymer faces outward and is visible to third parties, in particularly to support persons.

Alternatively the hearing apparatus can be formed as a behind-the-ear hearing aid, it being possible for the housing to have a curvature and to be formed on a convex outer side at least in part from the electrochrome polymer. In other words, the housing of the hearing apparatus formed as a behind-the-ear hearing aid can be formed from the electrochrome polymer on a side of the housing facing away from a gap between the ear and the head of the user. This ensures that the part of the housing formed from the electrochrome polymer is visible externally when the hearing appliance is worn in accordance with the requirements. In particular as regards support given to elderly people, this makes it especially easy to evaluate the information reproduced.

According to a second aspect of the invention the object referred to above is achieved by a hearing apparatus to be worn on or in the ear, including a housing, which has an organic light-emitting diode.

Organic light-emitting diodes can emit light in a wide variety of colors. Because the organic light-emitting diodes themselves can emit light, a greater contrast to the environment is possible, which proves to be especially advantageous as regards the evaluation of the information reproduced. Unlike conventional diodes, the application takes place in a printing procedure, as a result of which it is possible to provide any surfaces with organic light-emitting diodes. Thus light-emitting diodes are also used on heavily curved surfaces of hearing aids. In addition, very fine structures of display areas can be created in this way. Furthermore, one of the features of light-emitting diodes is their very low power draw.

Preferably the housing includes a display which is formed from a plurality of organic light-emitting diodes. As a result it is possible to display images of any color. Because organic light-emitting diodes can be printed on any practically any material, the cost and effort entailed in manufacture of the hearing apparatus are in particular reduced in comparison to conventional hearing aids with an LCD display. A further advantageous aspect when using organic light-emitting diodes, especially compared to the LCD display, is the more energy-efficient operation and thus the lower power draw, This aspect proves especially advantageous in the case of smaller hearing aids, such as in-the-ear hearing aids for example. Another advantage of a display formed from organic light-emitting diodes is that it has a bigger angle of view range than the conventional LCD displays. In particular as regards support given to elderly people, this makes possible a more reliable evaluation of the information reproduced.

Preferably a symbol can be displayed by means of the OLED display, as with the electrochrome display, which is assigned to an operating state of the hearing apparatus. In particular a separate symbol can be assigned to each operating state of the hearing apparatus and can be displayed in operation. It is also possible to display the current battery charge status of the hearing apparatus with the aid of symbols. In the case of elderly people in particular, the support person is then enabled to recognize the battery charge state with ease. In addition the symbols can also be used to customize the hearing apparatus.

In one embodiment the hearing apparatus can also be formed as an in-the-ear hearing aid, it being possible for the organic light-emitting diode to be arranged on a side of the housing facing away from a sound exit opening. This ensures that the area of the housing having the organic light-emitting diode always faces outward and that it is visible to the support person.

Alternatively the hearing apparatus can be formed as a behind-the-ear hearing aid, it being possible for the housing to have a curvature, and for the organic light-emitting diode to be arranged on a convex exterior of the housing. In particular the organic light-emitting diode is arranged on a side of the housing which faces away from a gap between the ear and the head of the user. This means that the organic light-emitting diode is visible externally, enabling the information reproduced to be better evaluated.

Preferably the hearing apparatus has an interface via which data characterizing the symbol can be transferred from an external computing facility. This means that the symbols assigned to the respective operating state of the hearing apparatus can be loaded onto the hearing apparatus via the interface, for example from the Internet. As a result any visually attractive embodiment of the hearing apparatus can be achieved. The computing facility can for example be a computer, a notebook or a cell phone.

Preferably the housing can reproduce at least two color tones. In particular when using electrochrome polymers, which are attached to the housing as fixed symbols, it is possible to use two color tones, one for the active and one for the inactive operating state of the hearing apparatus. Thus the active operating state of the hearing apparatus can be determined from the symbol color and thus the device status can be read. Color tones can additionally be used to customize the hearing apparatus.

Preferably the housing can be visually changed in line with a predetermined time pattern by the electrochrome polymer or the organic light-emitting diode. As a result a visually attractive embodiment of the hearing apparatus is achieved.

In one embodiment the housing can be changed visually as a function of a recorded sound and/or of a control signal. Besides the visual function, this enables a support person to read information about the sound currently being received.

Advantageous embodiments of the hearing apparatus according to the first or second aspect of the invention can be regarded as advantageous embodiments of the hearing apparatuses of the respective other aspect of the invention.

BRIEF DESCRIPTION OF THE DRAWINGS

Further advantages, features and details of the invention emerge from the following description of the preferred exemplary embodiments and on the basis of the drawings. These show.

DETAILED DESCRIPTION OF INVENTION

Figure 1:
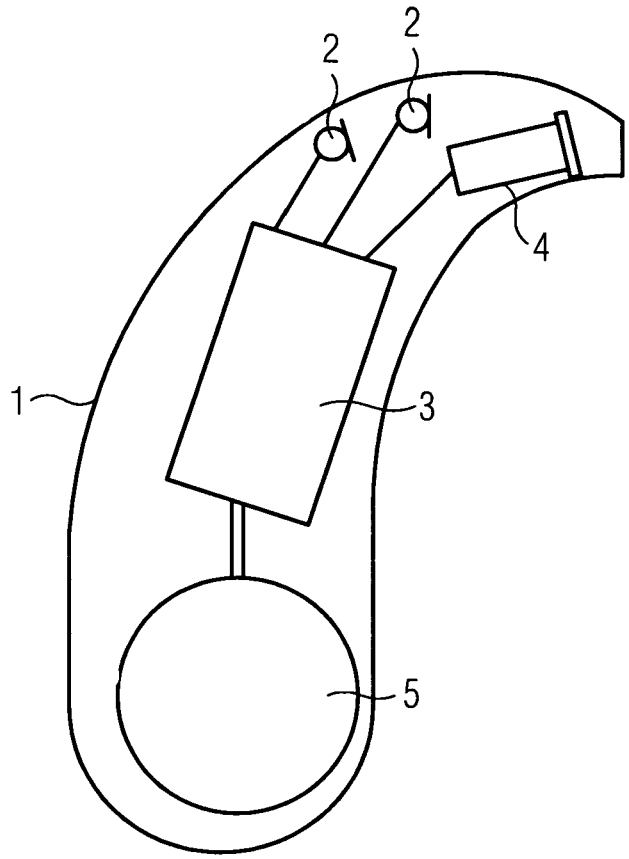
FIG 1 (Prior art)
FIG. 1 an outline structure of a behind-the-ear hearing aid according to the prior art.

In the figures the same or functionally equivalent elements are provided with the same reference characters.

The exemplary embodiments portrayed in greater detail below represent preferred embodiments of the present invention.

Figure 2:
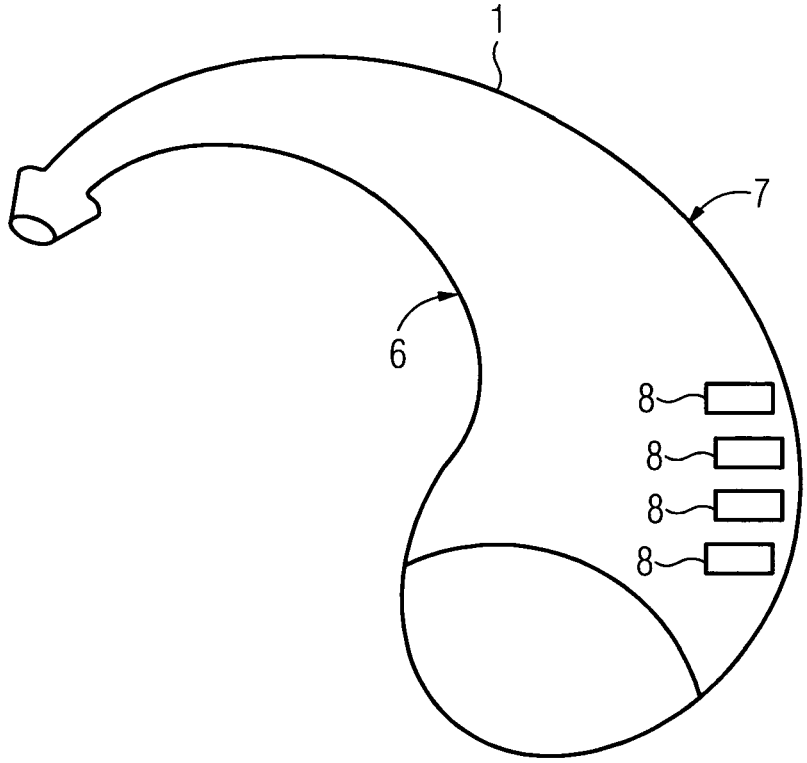
FIG. 2 a diagrammatic representation of a behind-the-ear hearing aid according to a first exemplary embodiment of the present invention, FIG. 3 a diagrammatic representation of a behind-the-ear hearing aid according to a second exemplary embodiment of the present invention.

A hearing apparatus according to a first exemplary embodiment reproduced in FIG. 2 is formed as a behind-the-ear hearing aid. The hearing aid has a hearing aid housing 1 which in this case is formed in conventional fashion as tube-shaped with a curved central line. The hearing aid housing 1 thus has a concave interior 6 and a convex exterior 7. When the hearing aid is worn in accordance with requirements the convex exterior 7 is directed-outward or, in other words, facing away from a gap between the ear and the head of the user.

According to the first exemplary embodiment the hearing aid housing 1 has four rectangular symbols 8, which in this case are each formed from an electrochrome polymer. Since electrochrome polymers represent a homogeneous material, it is possible to use the symbols 8 in very thin layers. In addition the symbols 8 can be applied to curved surfaces in a particularly simple manner. In the present example the symbols 8 are arranged on the convex exterior 7 of the hearing aid housing 1, so that they are visible to third persons, for example to support persons, when the hearing aid is worn in accordance with requirements. The symbols 8 formed from electrochrome polymers possess the attribute that their color-specific reflection behavior can be changed electrically. To this end the symbols 8 each include an electrical contact element, which for example is linked to a control unit of the hearing aid. Thus each symbol 8 is able to change its color depending on electrical excitation from the control unit side.

It can be noted here that the symbols 8 in this exemplary embodiment are arranged next to one another in the longitudinal direction of the hearing aid housing 1. The symbols 8 are here used to represent the charge status of a battery of the hearing aid. It is possible to assign all four symbols 8 an identical color, for example red, in the charged state of the battery. If the charge state of the battery is reduced, one of the symbols 8 adopts the color tone of the hearing aid housing 1. It can be provided for that in the event of an extremely low charge state of the battery, for example at five percent of the total capacity, all symbols 8 adopt the color tone of the hearing aid housing 1. This makes it possible to change the battery of the hearing aid in good time. Especially in the case of elderly hearing aid wearers who require assistance, the elegant solution using the symbols 8 made of electrochrome polymers permits a simple and reliable way of assessing the charge state of the battery and if appropriate changing the battery in good time.

Figure 3:
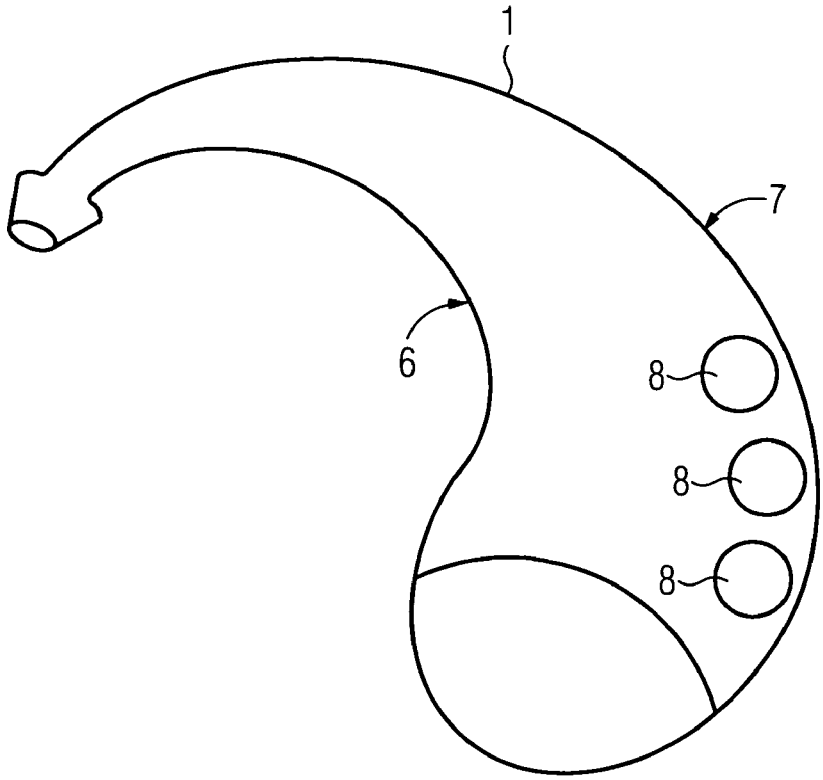

A hearing apparatus according to a second exemplary embodiment of the present invention shown in FIG. 3 is also formed as a behind-the-ear hearing aid. The hearing aid, as in the first exemplary embodiment, includes a hearing aid housing 1, which in conventional fashion has a concave interior 6 and a convex exterior 7. The hearing aid housing 1 here has three symbols 8 each formed from an electrochrome polymer. The symbols 8 are circular in this exemplary embodiment and are applied in the form of a thin layer to the hearing aid housing 1. Thanks to the arrangement of the symbols 8 on the convex exterior 7 of the hearing aid housing I it is again the case that they are directed outward when the hearing aid is worn in accordance with requirements, and are thus visible to third persons.

The symbols 8 each have an electrical contact element which, as in the first exemplary embodiment, is linked to a control unit of the hearing aid. This enables the color tone of the respective symbol 8 to change electrically in particularly simple fashion. In this exemplary embodiment each of the symbols 8 is assigned an operating state of the hearing aid. To this end each of the symbols 8 is assigned its own color tone. If the hearing aid is in a particular operating state, for example in telephone coil mode, a corresponding symbol 8 is highlighted by the change in its color tone. This enables the user or support person to read the device status via the symbol color. In addition the symbols 8 can be used to customize the hearing aid. Thus the color tones of the symbols 8 can be permanently programmed in or can be set as a function of signals, for example a microphone signal, the temperature, etc.

Figure 4:
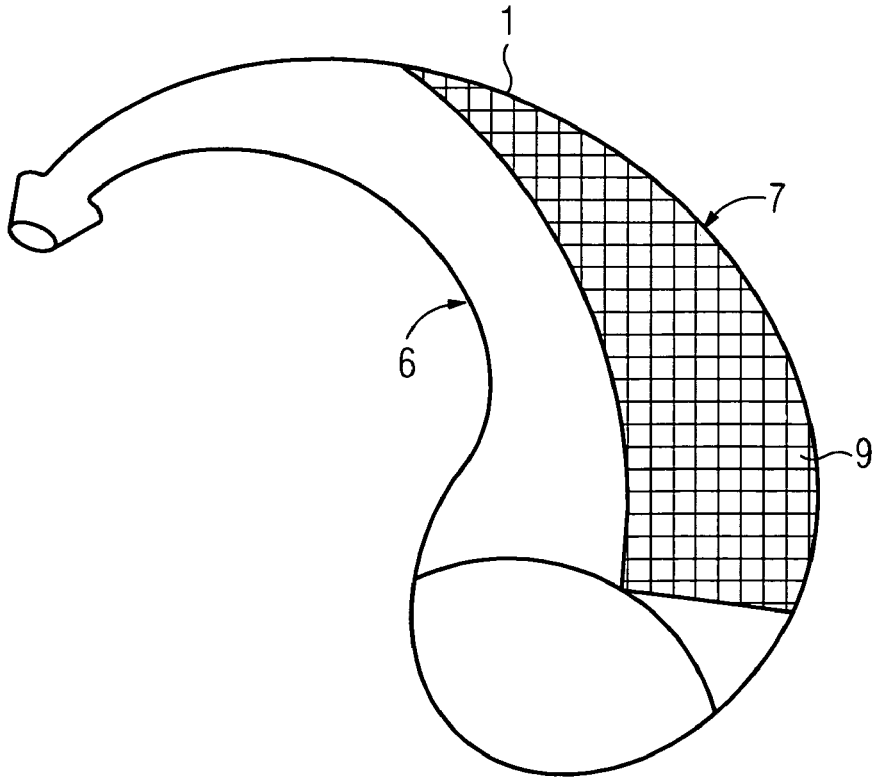
FIG. 4 a diagrammatic representation of a behind-the-ear hearing aid according to a third exemplary embodiment of the present invention.

A hearing apparatus according to a third exemplary embodiment of the present invention is shown in FIG. 4. The hearing apparatus is here formed as a behind-the-ear hearing aid with a hearing aid housing 1. As in the other exemplary embodiments, the hearing aid housing 1 has a concave interior 6 and a convex exterior 7 because of its tube-shaped, curved design.

In the third exemplary embodiment the hearing aid housing 1 has a display 9 consisting of a plurality of organic light-emitting diodes (OLED). The display 9 is arranged on the convex exterior 7 of the hearing aid housing 1, such that it is visible to third parties when the hearing aid is worn in accordance with requirements. However, it is also possible that the entire surface of the hearing aid housing 1 is provided with the display 9.

As mentioned, the organic light-emitting diodes can emit light in a wide variety of colors. Instead of the normal semiconductor processes, they are however applied in a printing process, so that it is possible to provide any surfaces, such as the curved surface of the hearing aid housing 1 in this case, with the organic light-emitting diodes. Because the organic light-emitting diodes themselves can emit light, a high contrast with the environment or the color tone of the hearing aid housing 1 is thereby permitted and the colors appear stronger. With hearing-aids in particular it is especially important that very fine structures can be generated with the organic light-emitting diodes. This guarantees that the resolution of the display 9 is relatively high.

According to the third exemplary embodiment the operating state of the hearing aid is displayed by the display 9. Thus for example the charge state of the battery and the current device status (e.g. the program switched on) can be displayed simultaneously. In addition it is possible to display any images on the display 9, so that any design can be assigned to the hearing aid. Thus for example the hearing aid can be customized by displaying any colored images. Provision can be made whereby the surface display can be altered in line with a fixed time pattern. Alternatively or additionally the surface display can also alter as a function of the sound or other control signals recorded.

In this case the hearing aid also has an interface via which data can be loaded from the Internet for example. This means that the symbols stored previously can be replaced by other symbols. It is possible to use this facility to customize the hearing aid.

Figure 5:
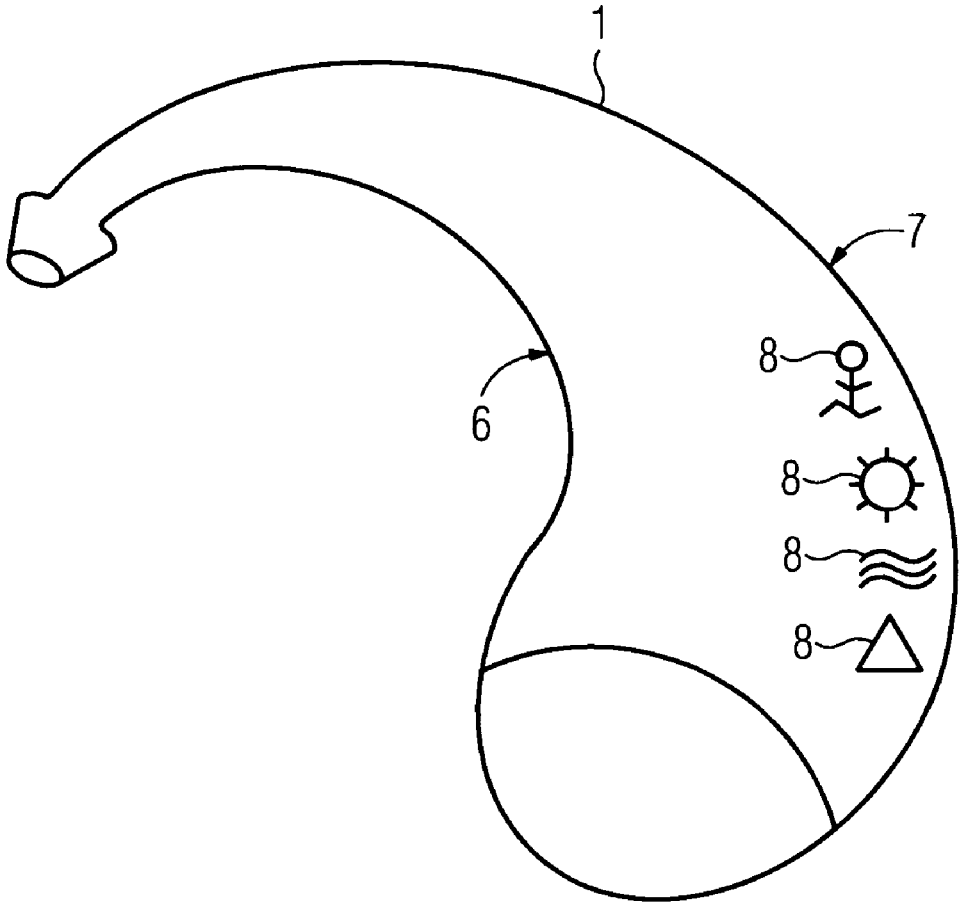
FIG. 5 a diagrammatic representation of a behind-the-ear hearing aid according to a fourth exemplary embodiment of the present invention.

A hearing apparatus according to a fourth exemplary embodiment of the present invention is reproduced in FIG. 5. The hearing appliance is formed as a behind-the-ear hearing aid as in the other exemplary embodiments. The hearing aid includes a hearing aid housing 1 which has a concave interior 6 and a convex exterior 7.

In this exemplary embodiment the hearing aid housing 1 has four different symbols 8 on the convex exterior 7, each of which is formed from an electrochrome polymer and which are applied in the form of thin layers to the hearing aid housing 1. The symbols 8 are arranged next to one another in the longitudinal direction of the hearing aid housing 1 and each represent a separate operating state of the hearing aid. Each of the symbols 8 has an electrical contact element, which in this case is linked to a control unit of the hearing aid and can be controlled thereby. As a result the color tones of each individual symbol 8 can be changed in simple fashion following electrical excitation. It is possible in the deactivated state of the hearing aid or in the deactivated state of the relevant operating mode to assign the color tone of the hearing aid housing 1 to the respective symbol 8. If a corresponding operating mode of the hearing aid is activated, the color of the relevant symbol 8 changes. This means that the user or the support person is enabled to read the device status via different symbols. The different structures of the symbols 8 can in addition be used to customize the hearing aid.

It can be noted here that all hearing apparatuses represented above can also be formed as in-the-ear hearing aids. In this case the symbols 8 or the display 9 can be arranged on a side of the hearing aid, which faces away from a sound exit opening or, when the hearing aid is worn in accordance with requirements, from the auditory canal.

The invention is not limited to the exemplary embodiments shown in the drawings. All features described above and shown in the drawings can be combined with one another as desired.

The invention claimed is:

1. A hearing apparatus to be worn on or in the ear, comprising:

a housing formed at least in part from an electrochrome polymer;

a signal processing unit contained within the housing which processes microphone signals and amplifies the microphone signals.

2. The hearing apparatus as claimed in claim 1, wherein the housing has an organic light-emitting diode.

3. The hearing apparatus as claimed in claim 1, wherein an outer layer of the housing is formed from the electrochrome polymer.

4. The hearing apparatus as claimed in claim 3, wherein the housing is formed entirely from one or more electrochrome polymers.

5. The hearing apparatus as claimed in claim 1, wherein an area of the housing made of the electrochrome polymer represents a symbol which is assigned to an operating state of the hearing apparatus.

6. The hearing apparatus as claimed in claim 5, further comprising an interface via which data characterizing the symbol is transferred from an external computing facility.

7. The hearing apparatus as claimed in claim 1, wherein a plurality of color tones are reproduced by the housing in which each of the color tones represents an operating state of the hearing apparatus.

8. A hearing apparatus to be worn on or in the ear, comprising:

a housing formed at least in part from an electrochrome polymer, wherein the hearing apparatus is an in-the-ear hearing aid, and wherein the housing is formed on the side facing away from a sound exit opening at least in part from the electrochrome polymer.

9. A hearing apparatus to be worn on or in the ear, comprising:

a housing formed at least in part from an electrochrome polymer, wherein the hearing apparatus is a behind-the-ear hearing aid, and wherein the housing has a curvature and is formed on a convex exterior at least in part from the electrochrome polymer.

10. A hearing apparatus to be worn on or in the ear, comprising:

a housing having an organic light-emitting diode;

a signal processing unit contained within the housing which processes microphone signals and amplifies the microphone signals.

11. The hearing apparatus as claimed in claim 10, wherein the housing includes a display formed from a plurality of organic light-emitting diodes.

12. The hearing apparatus as claimed in claim 11, wherein via the display a symbol which is assigned to an operating state of the hearing apparatus is displayed.

13. The hearing apparatus as claimed in claim 12, further comprising an interface via which data characterizing the symbol is transferred from an external computing facility.

14. The hearing apparatus as claimed in claim 10, wherein the hearing apparatus is an in-the-ear hearing aid, and wherein the organic light-emitting diode is arranged on a side of the housing facing away from a sound exit opening.

15. The hearing apparatus as claimed in claim 10, wherein the hearing apparatus is a behind-the-ear hearing aid, and wherein the housing has a curvature, and the organic light-emitting diode is arranged on a convex exterior of the housing.

16. The hearing apparatus as claimed in claim 10, wherein at least two color tones can be reproduced by the housing.

17. The hearing apparatus as claimed in claim 10, wherein the housing is visually changed as a function of a recorded sound and/or of a control signal.

18. The hearing apparatus as claimed in claim 16, wherein each of the color tones represents an operating state of the hearing apparatus.

* * * * *